US006897003B2

(12) United States Patent
Harada et al.

(10) Patent No.: US 6,897,003 B2
(45) Date of Patent: May 24, 2005

(54) TONER FOR RECYCLE SYSTEM AND TONER RECYCLING TYPE DEVELOPING METHOD

(75) Inventors: Yoshiaki Harada, Shizuoka (JP); Moriyuki Goto, Shizuoka (JP)

(73) Assignee: Tomoegawa Paper Co., Ltd., Tokyo (JP)

( * ) Notice: Subject to any disclaimer, the term of this patent is extended or adjusted under 35 U.S.C. 154(b) by 0 days.

(21) Appl. No.: 10/227,419

(22) Filed: Aug. 26, 2002

(65) Prior Publication Data

US 2003/0129514 A1 Jul. 10, 2003

(30) Foreign Application Priority Data

Aug. 31, 2001 (JP) ..... 2001-262625

(51) Int. Cl.[7] ..... G03G 21/10; G03G 9/087

(52) U.S. Cl. ..... 430/125; 430/108.7; 430/108.8; 430/109.3

(58) Field of Search ..... 430/125, 108.8, 430/108.7, 109.3

(56) References Cited

U.S. PATENT DOCUMENTS

| | | | | | |
|---|---|---|---|---|---|
| 5,240,814 | A | * | 8/1993 | Held | 430/124 |
| 5,707,772 | A | * | 1/1998 | Akimoto et al. | 430/108.8 |
| 5,906,906 | A | * | 5/1999 | Inoue et al. | 430/125 |
| 6,210,852 | B1 | * | 4/2001 | Nakamura | 430/109.3 |
| 2002/0025485 | A1 | | 2/2002 | Nakamura et al. | 430/109.3 |

FOREIGN PATENT DOCUMENTS

| | | | |
|---|---|---|---|
| EP | 0 978 766 | | 2/2000 |
| JP | 05-9223 | | 1/1993 |
| JP | 05-339327 | | 12/1993 |
| JP | 06-271628 | | 9/1994 |
| JP | 9-101631 | | 4/1997 |
| JP | 2000-66438 | | 3/2000 |
| JP | 2000-206732 | | 7/2000 |
| JP | 2000-275905 | * | 10/2000 |
| JP | 2000-284528 | | 10/2000 |
| WO | WO98/29783 | | 7/1998 |

OTHER PUBLICATIONS

Japanese Patent Office Machine–Assisted Translation of JP 2000–275905 (pub Oct. 2000).*

Japanese Patent Office Machine–Assisted Translation of JP 06–271628 (pub. Sep. 1994).

Japanese Patent Office Machine–Assisted Translation of JP 05–009223 (pub Jan. 1993).

* cited by examiner

*Primary Examiner*—Janis L. Dote
(74) *Attorney, Agent, or Firm*—McDermott Will & Emery LLP

(57) ABSTRACT

The invention provides a toner which can maintain sufficient image density upon continuous copying in a recycle system even under any environmental conditions without causing troubles such as fogging and toner dusting. The toner for recycle system comprises toner particles which contain, as a binder resin, at least a cycloolefin copolymer resin and, as a releasing agent, at least a polypropylene wax, and fine silica particles adhered to the surface of said toner particles. This toner is used for a toner recycling type developing method, in which the toner remaining on the surface of the photosensitive member is recovered into the developing device and is reused.

1 Claim, 2 Drawing Sheets

TONER FOR RECYCLE SYSTEM AND TONER RECYCLING TYPE DEVELOPING METHOD

BACKGROUND OF THE INVENTION

1. Field of the Invention

The present invention relates to a toner used for the toner recycle system in image forming device utilizing electrophotographic techniques, such as copying machines, printers, facsimile machines, etc. in which a toner remaining on the surface of the photosensitive member after the process of transferring to a recording sheet is reused as the developer, and to a toner recycling type developing method using such a toner.

2. Description of Related Art

Dry developers used for development in the image forming devices utilizing electrophotographic techniques are classified into a two-component developer consisting of a toner and a carrier such as ferrite powder, iron powder, glass beads, etc., a magnetic single-component developer comprising magnetic powder in the toner, and a nonmagnetic single-component developer. The toner used in these developers is composed of a binder resin and a colorant as main components, and additives such as a wax for improving low temperature fixability to recording sheets, a charge control agent for affording a polarity (positive charging or negative charging). The toner can be produced after blending these materials in a prescribed ratio by processes of melting, kneading, pulverizing and classifying to produce a powder. The toner is then subjected to surface treatment with external additives such as silica, titanium oxide, alumina and fine resin particles in order to control fluidity, chargeability, cleaning ability, preservability, etc., and is finally used as a developer.

By the way, in recent, image forming devices for which a mechanism of reusing the toner (recycle system) is added to the developing device is provided for the purpose of resource conservation and reduction in costs. In these image forming devices, it is generally adopted a toner recycle system which comprises scraping off the toner remaining on the surface of the photosensitive member by a cleaning blade or fur brush and transferring the recovered toner to a developer container to blend with the developer accommodated in the container.

The image forming devices using such a recycle system, however, have a problem that fogging and toner dusting are remarkably caused in the process of copying a large number of sheets. This problem is believed to be caused by increasing the amount of fine particles by destruction of the toner in the developing device. Accordingly, a toner, which is hard to become fine particles by destruction, has been required.

As a means for solving the above-mentioned problem in the recycle system, it has been proposed to use polyester resin that is not easily form fine particles as the binder resin. However, the toner using the polyester resin has a problem of having poor environmental stability.

The toner using a styrene-acrylic (methacrylic) acid ester copolymer has a problem of easily forming fine particles because of having poor strength for destruction, though it is excellent in environmental stability.

SUMMARY OF THE INVENTION

Accordingly, an object of the present invention is to solve the above problems in the recycle system, and is to provide a toner for recycle system holding sufficient image density without causing fogging and toner dusting even if a large number of sheets is copied continuously or copying is carried out under any environmental conditions. Another object of the present invention is to provide a toner recycling type developing method using such a toner.

The toner for recycle system according to the present invention comprises toner particles containing, as a binder resin, at least a cycloolefin copolymer resin and, as a release agent, at least a polypropylene wax, and silica fine particles attached to the surface of said toner particles.

The toner recycling type developing method according to the present invention comprises developing an electrostatic latent image formed on the surface of a photosensitive member with a toner, transferring the resultant toner image to a recording sheet, recovering the toner remaining on said photosensitive member, and reusing the recovered toner for development, wherein said toner comprises toner particles containing, as a binder resin, at least a cycloolefin copolymer resin and, at least a polypropylene wax as a releasing agent, and silica fine particles attached to the surface of said toner particles.

In the present invention, it is preferred that an amount of said silica fine particles attached to the surface of the toner particles is in a range of from 0.1% by weight to 1.5% by weight.

1: photosensitive drum (photosensitive member), 2: corona charger, 3: optical system, 4: developing device, 4*a*: developer container, 4*b*: developing sleeve, 5: corona transfer device, 6: developer, 6*a*: toner image, 6*b*: remaining toner, 7: recording sheet, 8: fixing device, 9: toner recovery device, 9*a*: cleaning blade, 9*b*: toner conveying device, 10: discharging device, 11: replenished toner.

Figure 2:
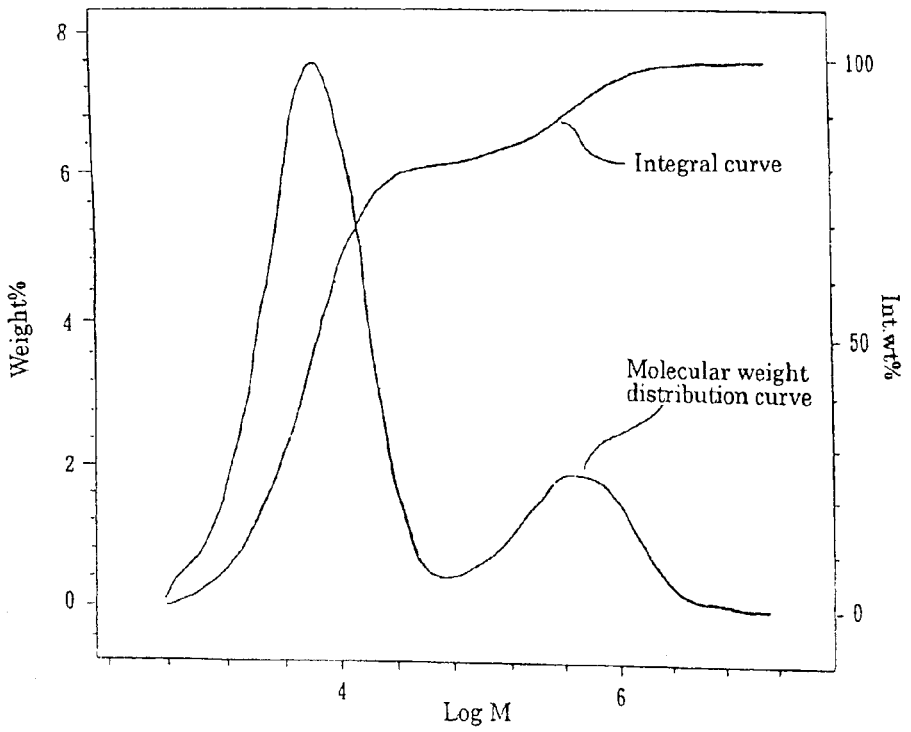

FIG. 2 is a graph that shows a molecular weight distribution curve of an ethylene-norbornene copolymer resin used in Example 1 and its weight integration curve.

Figure 3:
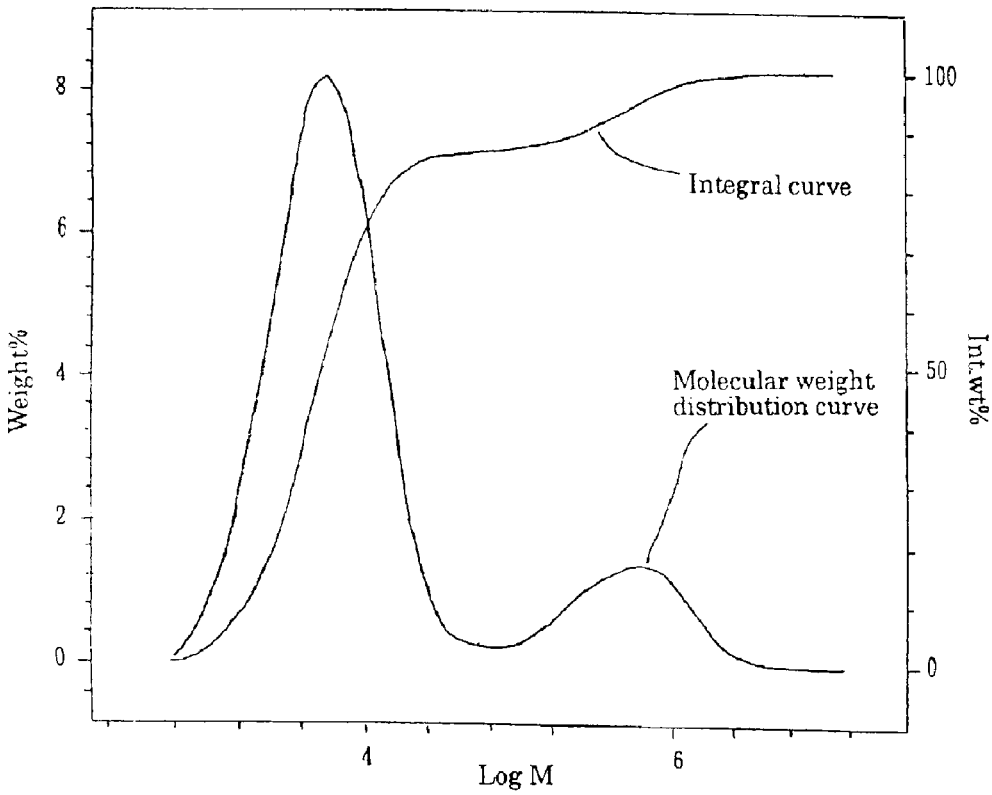

FIG. 3 is a graph that shows a molecular weight distribution curve of an ethylene-norbornene copolymer resin used in Example 2 and its weight integration curve.

DETAILED DESCRIPTION OF PREFERRED EMBODIMENTS

An embodiment of the present invention will hereinafter be illustrated with reference to the drawing.

Figure 1:
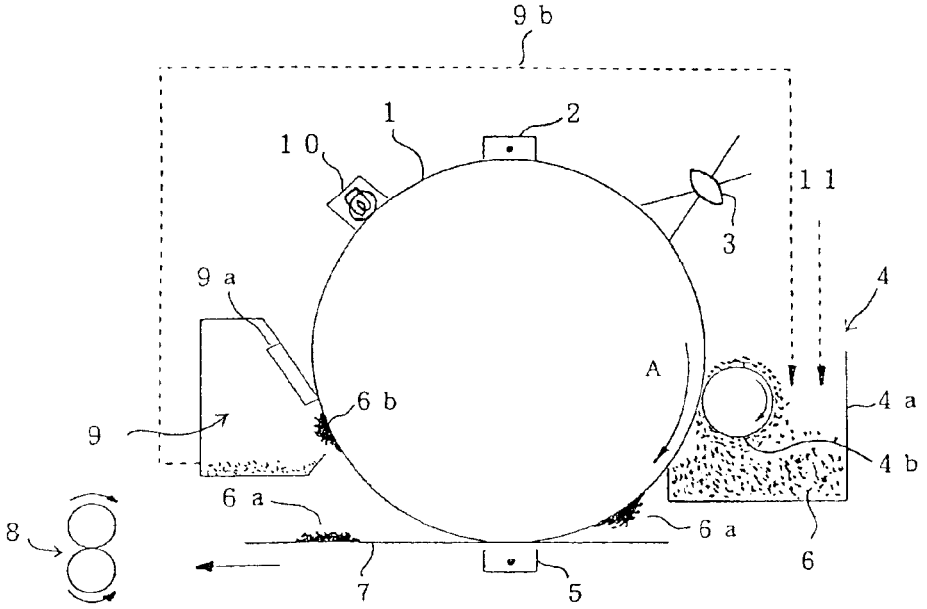
FIG. 1 is a summary configuration view of an image forming device to which the toner recycling type developing method according to the present invention is applied.

In FIG. 1, 1 is a photosensitive drum (photosensitive member) rotating in the arrow direction A. Around the photosensitive drum, a corona charger 2, an optical system 3, a developing device 4, a corona transfer device 5, a toner recovery device 9 and a discharging device 10 are arranged in this order in the rotating direction. The developing device is composed of a developer container 4*a* for accommodating a developer 6 (single-component type or two-component type) and a developing sleeve 4*b*. The toner recovery device is equipped with a cleaning blade 9*a*. A toner conveying device 9*b* for conveying the recovered toner is placed between the developing device and the cleaning device. 7 is a recording sheet (paper, resin film, etc.), 8 is a fixing device and 11 is a replenished toner fed from a toner supply device.

The image forming process by the above-mentioned image forming device is as follows. The surface of the rotating photosensitive drum 1 is first uniformly charged by corona discharging by means of the corona charger 2. An electrostatic latent image is then formed on the surface of the photosensitive drum 1 by image-wise exposure by means of the optical system 3. The developing sleeve 4*b* rotates, while the developer 6 in the developer container 4*a* is adsorbed thereon. The toner in the developer 6 (the developer 6 is composed of only the toner in case of single-component type developer) is adsorbed on the electrostatic latent image formed on the surface of the photosensitive drum 1 by the action of the reversed polarity, thereby the latent image being visualized as a toner image 6*a*. A recording sheet 7 is then placed on the toner image 6*a* by being conveyed between the photosensitive drum 1 and the corona transfer device 5. A transfer charge is afforded to the back of the recording sheet by means of the corona transfer device 5 to transfer the toner image 6*a* on the recording sheet 7. Thereafter, the recording sheet 7 is passed between rolls of the fixing device 8 to fix the toner image 6*a* on the recording sheet 7. On the other hand, the toner 6*b* remaining of the surface of the photosensitive drum 1 without transferring to the recording sheet 7 is scraped by means of the cleaning blade 9*a* and recovered by the recovery device 9. Thus, the surface of the photosensitive drum 1 is cleansed by this operation, and is then discharged by the discharging device 10. The recovery toner scraped by the cleaning blade 9*a* is conveyed to the developer container 4*a* by means of the toner conveying device 9*b* so as to be reused. In this case, since the amount of the toner in the developer 6 becomes small by repeating the copying operation, a replenished toner 11 is supplied for suitably keeping the amount of the toner in the developer 6.

The developer used in the above-mentioned image forming process may be any of the single-component type magnetic or nonmagnetic developer and the two-component type developer. In the case of one-component system, the toner itself is used as a developer, and, in the case of two-component system, the toner is blended with a carrier.

The toner according to the present invention used in the above-mentioned image forming process will be illustrated hereafter.

The toner according to the present invention is composed of toner particles and silica fine particles. The toner particles are composed of a binder resin comprising a cycloolefin copolymer resin and a polypropylene wax as essential components, and other ingredients such as a colorant, a releasing agent, a charge controlling agent and other additives added as occasion demands.

In the toner particles of the present invention, the binder resin should be contained at least a cycloolefin copolymer resin. The cycloolefin copolymer resin is a polyolefin resin having a cyclic structure which is a copolymer of alpha-olefin such as ethylene, propylene, butylene, etc. and cycloolefin having a double bond such as cyclohexene, norbornene, tetracyclododecene, etc. The cycloolefin copolymer resin may be any of random copolymer and block copolymer. The cycloolefin copolymer resin can be produced by known polymerization methods using a metallocene catalyst or a Ziegler catalyst. It can be synthesized by methods disclosed in, for example, Japanese Patent Application Laid-open Nos. 5-339327, 5-9223 and 6-271628.

The copolymerization ratio of cycloolefin and alpha-olefin in the cycloolefin copolymer resin can be widely varied by suitably setting a feed molar ratio for the reaction of them so as to obtain a desired product. In concrete, the amount of cycloolefin to the sum total of them is set in a range of 2–98% by mol, preferably 2.5–50% by mol and more preferably 2.5–35% by mol. In a case of reacting, for example, ethylene as the alpha-olefin with norbornene as the cycloolefin, a glass transition temperature (Tg) of the cycloolefin copolymer resin as the reaction product is largely influenced upon the feed ratio of them. When the feed ratio of norbornene increases, Tg is also in the tendency which becomes high. For example, the feed amount of norbornene is about 60% by weight, a copolymer having Tg of about 60–70° C. can be obtained.

In the present invention, it is preferred that the above-mentioned cycloolefin copolymer resin consists of a low molecular weight fraction having a peak and a high molecular weight fraction having a peak in the molecular weight distribution measured by gel permeation chromatography (referred to as "GPC", hereafter), wherein the low molecular weight fraction has a number average molecular weight of less than 7500 and the high molecular weight fraction has a number average molecular weight of 7500 or more, and the high molecular weight fraction is contained in an amount of 50–5% by weight, and more preferably 30–5% by weight, in the binder resin. If the amount of the high molecular weight fraction exceeds 50% by weight, uniformly kneading property of the toner very deteriorates to cause trouble in the toner performance. In addition, sufficient fixing strength cannot be obtained in low temperature fixation. If it is lower than 5% by weight, a sufficient tolerance of non-offset temperature cannot be obtained.

The above-mentioned cycloolefin copolymer resin in the present invention may be a mixture of a lower molecular weight cycloolefin copolymer having a number average molecular weight of less than 7500 and a higher molecular weight cycloolefin copolymer having a number average molecular weight of at least 7500. It may also be a product obtained by controlling synthesis conditions so as to have a peak in each of the low molecular weight fraction having a number average molecular weight of less than 7500 and the high molecular weight fraction having a number average molecular weight of at least 7500, respectively.

In the present specification, the term "fraction" is defined as follows. In the case that the cycloolefin copolymer resin is composed of a mixture of resins having each a different number average molecular weight, the term "fraction" means each resin before mixing. In the case of single cycloolefin copolymer resin prepared by synthesis, the term "fraction" means each portion having a peak bordering on the minimum part between the two peaks in the molecular weight distribution measured by the GPC method.

In this invention, although it is preferred to use a cycloolefin copolymer resin in which a low molecular weight fraction having a number average molecular weight (referred to as "Mn" hereafter) of less than 7500 and a high molecular weight fraction having Mn of 7500 or more are contained in the above-mentioned ratio, the low molecular weight fraction is more preferred to have Mn of 1000 to less than 7500 and, particularly, Mn of 3000 to less than 7500, and the high molecular weight fraction is more preferred to have Mn of 7500 to 1000000 and, particularly, Mn of 50000 to 700000. With respect to a weight average molecular weight (referred to as "Mw", hereafter), a cycloolefin copolymer resin in which the low molecular weight fraction has Mw of less than 15000, more preferably 1000 to less than 15000, and particularly 4000 to less than 15000, and the high molecular weight fraction has Mw of 15000 or more and more preferably 100000 to 1500000 can be suitably used.

Furthermore in this invention, carboxyl groups may be introduced into the above-mentioned cycloolefin copolymer resin by a fusing air-oxidation method or by modification with maleic anhydride. Thus, compatibility with other resins and the dispersibility of pigments can be improved thereby. Moreover, the same effect can also be obtained by introducing hydroxyl groups or amino groups by the known methods. Furthermore, it is also possible to improve fixability of the toner by introducing a cross-linking structure to the cycloolefin copolymer resin by copolymerizing with a diene monomer such as norborunadiene, cyclohexadiene, tetracyclododecadiene, etc., or by adding metal such as zinc, copper, calcium, etc. to the cycloolefin copolymer resin to which carboxyl groups were introduced.

In the present invention, other resins may be used together with the above-mentioned cycloolefin copolymer resin as the binder resins. In this case, the cycloolefin copolymer resin is incorporated in such an amount that it is preferably in a range of 20–100% by weight and more preferably 50–100% by weight based on all binder resins. When the amount of the cycloolefin copolymer resin is less than 20% by weight, a sufficient image density cannot be maintained under all environmental conditions upon continuously copying a large number of sheets, and problems of fogging and toner dusting come to arise.

Examples of other resins which can be used together with the cycloolefin copolymer resin include polystyrene resin, poly acrylic acid ester resin, styrene-acrylic acid ester copolymer resin, styrene-methacrylic acid ester copolymer resin, polyvinyl chloride, polyvinyl acetate, polyvinylidene chloride, phenol resin, epoxy resin, polyester resin, etc. In particular, in order to improve fixability of the toner, it is preferred to use a resin having a melting start temperature (softening point) as low as possible (for example, 120–150° C.). Further, in order to improve preservability of the toner, it is preferred to use a resin having a glass transition temperature of 65° C. or higher.

It is required for the toner of the present invention to add a polypropylene wax as a releasing agent. In general, a polypropylene wax having an average molecular weight of 2000–20000, a softening point of 140–160° C., and a penetration number of 2 or less is generally preferably used. The amount of the polypropylene wax in the toner particles is preferred in a range of 0.5–8.0% by weight and more preferably 1.0–5.0% by weight. By making the polypropylene wax contain together with the above-mentioned cycloolefin copolymer resin, excellent releasability which cannot be exhibited with other waxes is maintained, and thus the toner will become suitable for recycling.

As the colorant, known colorant such as carbon black, aniline blue, Chalcoil blue, chrome yellow, ultra marine blue, Du Pont oil red, Quinoline Yellow, Methylene Blue chloride, Phthalocyanine Blue, Marachite Green oxalate, lampblack, Rose Bengale, etc. can be used independently or as a mixture of two or more of them. The colorant is necessary to be contained in an amount sufficient to form visible images of sufficient density. It is therefore incorporated in an amount of 1–20 parts by weight based on 100 parts by weight of the binder resin.

The charge controlling agent, which is classified into an agent for positively charging toner and an agent for negatively charging toner, can be added for affording polarity to the toner. Nigrosine dyes, quaternary ammonium salts, pyridinium salts, azines etc. are used for the positively charging toner, and azo type metal complexes and salicylic acid type metal complexes are used for the negatively charging toner. A preferable amount of the charge controlling agent is in a range of 0.1–5 parts by weight based on 100 parts by weight of the binder resin. The charge controlling agent may be, used alone or as a mixture of two or more thereof.

As other additives added as occasion demands, magnetic powder, low melting point wax, etc. are usable.

As the magnetic powder, fine particles, such as ferrite powder, magnetite powder, and iron powder are usable. As the ferrite powder, a mixed sintering material of MeO—$Fe_2O_3$ is used for the present invention. Specific examples of MeO in this case include oxides of Mn, Zn, Ni, Ba, Co, Cu, Li, Mg, Cr, Ca, and V, one or more of which can be used in the present invention. Furthermore, as the magnetite powder, a mixed sintering material of FeO—$Fe_2O_3$ is used for the present invention. It is preferred that the magnetic powder has a particle diameter of 0.05–3 $\mu$m and that the amount of it is 70% by weight or less in the toner.

A low melting point wax is added for the purpose of reducing the melting start temperature of toner to improve fixability thereof at low temperature or as a releasing agent. Synthetic waxes other than the above-mentioned polypropylene wax, petroleum wax, etc. are used for such a purpose. As the synthetic wax, Fischer-Tropsch wax etc. can be used. Examples of the petroleum wax include paraffin wax, microcrystalline wax, petrolatum, etc. As the other waxes, natural wax such as carnauba wax, rice wax, candelilla wax, etc. and synthetic waxy fats are usable.

The toner particles composing the toner of the present invention can be produced by a process which comprises blending the above-mentioned material at a prescribed rate, kneading the resultant mixture with melting, pulverizing and classifying. They may also be produced by a polymerization process using the above-mentioned materials. In general, the volume average particle diameter of the toner particles is set as the range of 5–15 $\mu$m.

In the toner of the present invention, it is preferred that silica fine particles adhere in an amount of 0.1–1.5% by weight to the toner particles. When the amount of adhesion of the silica particles is less than 0.1% by weight, poor supply of the toner and inferior preservability of the toner are brought about, because the fluidity of the toner is bad. When it is larger than 1.5% by weight, the silica fine particles easily leave the toner particles to cause troubles such as filming, etc. In order to adhere the silica particles to the toner particles, it is possible to use a method of mixing with a common blending machine such as a turbine agitator, a HENSCHEL MIXER, super-mixer, etc.

In order to control fluidity, tribo-charging ability, cleaning property and preservability of the toner, external additives besides the silica fine particles, such as magnetic powder, alumina, talc, clay, calcium carbonate, magnesium carbonate, titanium dioxide and various kinds of resin fine particles may be adhered to the toner particles.

As explained above, the toner for recycle system according to the present invention has both of pulverization resistance and environmental resistance, because a cycloolefin copolymer resin is used as the binder resin, a polypropylene wax is used as the releasing agent, and a prescribed amount of silica fine particles is adhered to the surface of the toner particles. Accordingly, when the toner is used for the toner recycling type developing method, the toner is not destroyed and pulverized in the developer container and has a proper triboelectric charging amount under every environmental conditions, even if subjected mechanical load in the developing device. Thus, problems such as fogging, toner dusting, and generation of the offset phenomenon do not occur according to the present invention, even if a large number of sheets are continuously copied.

EXAMPLES

The present invention will be illustrated in detail with reference to the following Examples and Comparative Examples. However, the present invention is not restricted to these examples.

First, the following toners A–G were produced.

Example 1

(Production of Toner A)

| | |
|---|---|
| Ethylene-norbornene copolymer resin (refer to FIG. 2) (trade name: TOPAS COC, manufactured by TICONA GMBH. Mn = 5020, Mw = 138000, Mw/Mn = 27.5 Low molecular weight fraction: Mn4080, Mw = 7960 High molecular weight fraction: Mn = 291300, Mw = 703400, Ratio of the high molecular weight fraction/ the low molecular weight fraction = 18.5/81.5) | 100 parts by weight |
| Polypropylene wax (trade name: Viscol 550P, manufactured by Sanyo Chemical Industries, Ltd.) | 3 parts by weight |
| Metallized dye (trade name: Bontron S-34, manufactured by Orient Chemical Industries, Ltd.) | 2 parts by weight |
| Carbon black (trade name: MA-100, manufactured by Mitsubishi Chemical Corporation) | 10 parts by weight |

The above-mentioned raw materials were blended by a super-mixer. After the mixture was melted and kneaded with heat by a biaxial extruder, it was pulverized by a jet mill. It was then classified by a dry type air stream classifier to obtain toner particles having a volume average particle diameter of 9 $\mu$m.

To the resultant toner particles, was added hydrophobic silica (trade name: R-972, manufactured by Nippon Aerosil Co., Ltd.) so that the amount of adhesion was 0.5% by weight to the toner, followed by blending by a HENSCHEL MIXER at a circumference rate of 40 m/second for 8 minutes to obtain Toner A.

Example 2

(Production of Toner B)

| | |
|---|---|
| Ethylene-norbornene copolymer resin (refer to FIG. 3) (trade name: TOPAS COC, manufactured by TICONA GMBH. Mn = 4250, Mw = 96100, Mw/Mn = 22.6 Low molecular weight fraction: Mn = 3630, Mw = 6790 High molecular weight fraction: Mn = 309100, Mw = 683800, Ratio of the high molecular weight fraction/the low molecular weight fraction = 12.5/87.5) | 100 parts by weight |
| Polypropylene wax (trade name: Viscol 550P, manufactured by Sanyo Chemical Industries, Ltd.) | 3 parts by weight |
| Metallized dye (trade name: Bontron S-34, manufactured by Orient Chemical Industries, Ltd.) | 2 parts by weight |
| Carbon black (trade name: MA-100, manufactured by Mitsubishi Chemical Corporation) | 12 parts by weight |

The above-mentioned raw materials were blended by a super-mixer. After the mixture was melted and kneaded with heat by a biaxial extruder, it was pulverized by a jet mill. It was then classified by a dry type air stream classifier to obtain toner particles having a volume average particle diameter of 9 $\mu$m.

To the resultant toner particles, was added hydrophobic silica (trade name: R-972, manufactured by Nippon Aerosil Co., Ltd.) so that the amount of adhesion was 1.5% by weight, followed by blending by a HENSCHEL MIXER at a circumference rate of 40 m/second for 8 minutes to obtain Toner B.

Example 3

(Production of Toner C)

| | |
|---|---|
| Ethylene-norbornene copolymer resin (The same as that used for Toner A) | 100 parts by weight |
| Polypropylene wax (trade name: Viscol 550P, manufactured by Sanyo Chemical Industries, Ltd.) | 3 parts by weight |
| Metallized dye (trade name: Bontron S-34, manufactured by Orient Chemical Industries, Ltd.) | 2 parts by weight |
| Carbon black (trade name: MA-100, manufactured by Mitsubishi Chemical Corporation) | 12 parts by weight |

The above-mentioned raw materials were blended by a super-mixer. After the mixture was melted and kneaded with heat by a biaxial extruder, it was pulverized by a jet mill. It was then classified by a dry type air stream classifier to obtain toner particles having a volume average particle diameter of 9 $\mu$m.

To the resultant toner particles, hydrophobic silica (trade name: R-972, manufactured by Nippon Aerosil Co., Ltd.) and titanium dioxide (trade name: SMT-150AIK, manufactured by TAYCA CORPORATION) were added so that the amount of adhesion of the silica was 0.2% by weight and that of the titanium dioxide was 0.2% by weight, followed by blending by a HENSCHEL MIXER at a circumference rate of 40 m/second for 8 minutes to obtain Toner C.

Example 4

(Production of Toner D)

| | |
|---|---|
| Ethylene-norbornene copolymer resin (The same as that used for Toner B) | 100 parts by weight |
| Polypropylene wax (trade name: Viscol 550P, manufactured by Sanyo Chemical Industries, Ltd.) | 2 parts by weight |
| Natural wax (trade name: Carnauba wax No. 2 powder, manufactured by Nippon Wax Co.) | 2 parts by weight |
| Metallized dye (trade name: Bontron 5-34, manufactured by Orient Chemical Industries, Ltd.) | 2 parts by weight |
| Carbon black (trade name: MA-100, manufactured by Mitsubishi Chemical Corporation) | 10 parts by weight |

The above-mentioned raw materials were blended by a super-mixer. After the mixture was melted and kneaded with heat by a biaxial extruder, it was pulverized by a jet mill. It was then classified by a dry type air stream classifier to obtain toner particles having a volume average particle diameter of 9 $\mu$m.

To the obtained toner particles, was added hydrophobic silica (trade name: R-972, manufactured by Nippon Aerosil Co., Ltd.) so that the amount of adhesion was 0.5% by weight, followed by blending by a HENSCHEL MIXER at a circumference rate of 40 m/second for 8 minutes to obtain Toner D.

| Comparative Example 1 (Production of Toner E) | |
|---|---|
| Polyester resin (trade name: FC-316, manufactured by Mitsubishi Rayon Co., Ltd.) | 100 parts by weight |
| Polypropylene wax (trade name: Viscol 550P, manufactured by Sanyo Chemical Industries, Ltd.) | 2 parts by weight |
| Metallized dye (trade name: Bontron S-34, manufactured by Orient Chemical Industries, Ltd.) | 2 parts by weight |
| Carbon black (trade name: MA-100, manufactured by Mitsubishi Chemical Corporation) | 10 parts by weight |

The above-mentioned raw materials were blended by a super-mixer. After the mixture was melted and kneaded with heat by a biaxial extruder, it was pulverized by a jet mill. It was then classified by a dry type air stream classifier to obtain toner particles having a volume average particle diameter of 9 μm.

To the obtained toner particles, was added hydrophobic silica (trade name: R-972, manufactured by Nippon Aerosil Co., Ltd.) so that the amount of adhesion was 0.5% by weight, followed by blending by a HENSCHEL MIXER at a circumference rate of 40 m/second for 8 minutes to obtain Toner E.

| Comparative Example 2 (Production of Toner F) | |
|---|---|
| Styrene-acrylic acid ester copolymer resin (trade name: CPR-100, manufactured by Mitsui Chemicals Inc.) | 100 parts by weight |
| Polypropylene wax (trade name: Viscol 550P, manufactured by Sanyo Chemical Industries, Ltd.) | 2 parts by weight |
| Metallized dye (trade name: Bontron S-34, manufactured by Orient Chemical Industries, Ltd.) | 2 parts by weight |
| Carbon black (trade name: MA-100, manufactured by Mitsubishi Chemical Corporation) | 10 parts by weight |

The above-mentioned raw materials were blended by a super-mixer. After the mixture was melted and kneaded with heat by a biaxial extruder, it was pulverized by a jet mill. It was then classified by a dry type air stream classifier to obtain toner particles having a volume average particle diameter of 9 μm.

To the obtained toner particles, was added hydrophobic silica (trade name: R-972, manufactured by Nippon Aerosil Co., Ltd.) so that the amount of adhesion was 0.5% by weight, followed by blending by a HENSCHEL MIXER at a circumference rate of 40 m/second for 8 minutes to obtain Toner F.

Comparative Example 3

(Production of Toner G)

Toner G was produced by the same manner as in Example 1 except that polyethylene wax (trade name: PE-130, manufactured by Clariant (Japan) K.K.) was used instead of polypropylene in Toner A of Example 1.

Next, developers were produced by blending each 4 parts by weight of the above-mentioned Toners A–G with 100 parts by weight of a silicone resin coated ferrite carrier. Each of these developers was then put in a developing device of a copying machine which adopted recycling system shown in FIG. 1. An A4 manuscript having a black solid ratio of 6% was copied on 10000 sheets of A4 transfer paper while supplying the above-mentioned toner as a replenished toner. The copying was carried out under each of environmental conditions: normal temperature and normal humidity (N/N) (20° C., 58% RH), high temperature and high humidity (H/H) (32° C., 85% RH), and low temperature and low humidity (L/L) (10° C., 20% RH); and tribo-electro-charge amount, image density, fogging, and toner dusting were evaluated. The evaluation results are shown in Table 1.

The tribo-electro-charge amount (Q/M) is a value obtained by using a blow-off charge amount measuring equipment manufactured by Toshiba Chemical Corp., the image density (ID) is a value of the solid image measured by a MacBeth reflective densitometer RD-914, and the fogging (BG) is a value measured by a color meter ZE2000 manufactured by Nippon Denshoku Industries, Ltd. Moreover, the toner dusting is observed in the visual observation about contamination of the circumference of the developing device by the toner, wherein A means no contamination having generated, and B means the contamination having remarkably generated.

TABLE 1

| | | Initial | | | After copying 10000 sheets under N/N | | | |
|---|---|---|---|---|---|---|---|---|
| | Toner used | Q/M (μc/g) | ID | BG | Q/M (μc/g) | ID | BG | Toner scattering |
| Ex. 1 | A | −25.0 | 1.38 | 0.40 | −26.1 | 1.39 | 0.56 | A |
| Ex. 2 | B | −30.5 | 1.37 | 0.35 | −31.2 | 1.38 | 0.41 | A |
| Ex. 3 | C | −21.5 | 1.40 | 0.53 | −21.0 | 1.41 | 0.60 | A |
| Ex. 4 | D | −28.5 | 1.38 | 0.50 | −30.0 | 1.40 | 0.63 | A |
| Com. Ex. 1 | E | −26.5 | 1.38 | 0.43 | −27.5 | 1.39 | 0.53 | A |
| Com. Ex. 2 | F | −28.2 | 1.39 | 0.56 | −24.5 | 1.42 | 0.78 | A |
| Com. Ex. 3 | G | −28.0 | 1.38 | 0.50 | −29.0 | 1.36 | 0.63 | A |

| | | After copying 10000 sheets under L/L | | | | After copying 10000 sheets under H/H | | | |
|---|---|---|---|---|---|---|---|---|---|
| | Toner used | Q/M (μc/g) | ID | BG | Toner scattering | Q/M (μc/g) | ID | BG | Toner scattering |
| Ex. 1 | A | −29.3 | 1.37 | 0.35 | A | −24.0 | 1.40 | 0.50 | A |
| Ex. 2 | B | −34.0 | 1.36 | 0.50 | A | −27.3 | 1.40 | 0.61 | A |

TABLE 1-continued

| | | | | | | | | | |
|---|---|---|---|---|---|---|---|---|---|
| Ex. 3 | C | −23.0 | 1.39 | 0.64 | A | −20.3 | 1.42 | 0.39 | A |
| Ex. 4 | D | −30.5 | 1.38 | 0.61 | A | −26.3 | 1.40 | 0.52 | A |
| Com. Ex. 1 | E | −23.5 | 1.40 | 0.98 | B | −32.0 | 1.33 | 0.31 | A |
| Com. Ex. 2 | F | −30.2 | 1.37 | 0.75 | B | −24.8 | 1.40 | 0.90 | B |
| Com. Ex. 3 | G | −32.0 | 1.35 | 0.50 | A | −23.0 | 1.42 | 0.90 | B |

As be clear from the results shown in Table 1, in the recycling development method using the toners of Examples 1–4, both of the initial image density and the image densities after being copied 10000 sheets under each environmental condition were 1.36 or more, and the fogging was 0.64 or less, which meant that the copying could be carried out satisfactorily without causing practical troubles. Furthermore, no toner dusting was observed.

To the contrary, in Comparative Examples 1–3, it was observed under the conditions of L/L and H/H that the fogging and toner dusting were caused remarkably, and that chargeability and environmental characteristics were badly influenced by environmental characteristics of the resin, and fine pulverization of the resin. Moreover, in the case of Comparative Example 3, the developer caused an offset phenomenon after 10000 sheets being copied under the condition of H/H, and it could not be practically used.

What is claimed is:

1. A toner recycling developing method which comprises developing an electrostatic latent image formed on the surface of a photosensitive member with a toner, transferring the resultant toner image to a recording sheet, recovering the toner remaining on said photosensitive member, and reusing the recovered toner for development, wherein said toner comprises toner particles containing, as a binder resin, at least a cycloolefin copolymer resin and, as a releasing agent, at least a polypropylene wax, and silica fine particles adhered to the surface of said toner particles, wherein said cycloolefin copolymer resin consists of a low molecular weight fraction having a peak and a high molecular weight fraction having a peak in the molecular weight distribution measured by GPC, said low molecular weight fraction has a number average molecular weight of less than 7,500 and said high molecular weight fraction has a number average molecular weight of more than 50,000 and less than 700,000, and said high molecular weight fraction is contained in an amount of 50 to 5% by weight in the binder resin.

* * * * *